US006544130B1

(12) United States Patent
Weidenhammer

(10) Patent No.: US 6,544,130 B1
(45) Date of Patent: Apr. 8, 2003

(54) PRACTICE GOLF BALL DEVICE AND ITS ASSOCIATED METHOD OF MANUFACTURE

(76) Inventor: Mark Weidenhammer, 284 Newton-Richboro Rd., Richboro, PA (US) 18954

( * ) Notice: Subject to any disclaimer, the term of this patent is extended or adjusted under 35 U.S.C. 154(b) by 0 days.

(21) Appl. No.: 09/655,143

(22) Filed: Sep. 5, 2000

(51) Int. Cl.[7] ..... A63B 37/06

(52) U.S. Cl. ..... 473/351; 473/358; 473/370; 264/266

(58) Field of Search ..... 473/351, 377, 473/384, 280, 148, 165, 358, 378, 365, 604, 607, 609; 273/317.9, 317.7; 264/308, 264–279.1, 255

(56) References Cited

U.S. PATENT DOCUMENTS 1,209,644 A * 12/1916 Price
2,597,704 A * 5/1952 Carlson
4,660,834 A * 4/1987 Carrigan ..... 473/165
4,836,552 A 6/1989 Puckett et al. ..... 273/218
4,874,169 A * 10/1989 Litchfield ..... 473/613
5,006,297 A * 4/1991 Brown et al. ..... 264/234
5,143,788 A * 9/1992 Johnson
5,569,418 A * 10/1996 Russo, Sr. ..... 264/36.12
5,730,665 A * 3/1998 Shimosaka et al. ..... 473/376
5,779,562 A * 7/1998 Melvin et al.
5,782,702 A 7/1998 Yamagishi et al. ..... 473/280
5,816,943 A * 10/1998 Masutani et al.
5,836,833 A * 11/1998 Shimosaka et al.
5,849,168 A * 12/1998 Lutz
5,882,567 A * 3/1999 Cavallaro et al. ..... 264/255
5,944,621 A * 8/1999 Tsujinaka et al. ..... 473/369
5,980,395 A * 11/1999 Tsunoda et al. ..... 473/373
5,989,136 A * 11/1999 Renard et al.
5,997,416 A * 12/1999 Maruko ..... 473/371
5,997,417 A * 12/1999 Lutz
6,019,921 A * 2/2000 Lutz
6,042,768 A * 3/2000 Calabria et al. ..... 264/135
6,068,561 A * 5/2000 Renard et al.
6,290,797 B1 * 9/2001 Gosetti et al. ..... 156/228
6,309,313 B1 * 10/2001 Peter ..... 473/378

* cited by examiner

*Primary Examiner*—Paul T. Sewell
*Assistant Examiner*—Nini F. Legesse
(74) *Attorney, Agent, or Firm*—LaMorte & Associates

(57) ABSTRACT

A practice golf ball and its associated method of manufacture is claimed. The practice golf ball includes a hollow inner shell made of inexpensive molded plastic. The inner shell is molded so that the outer surface of the inner shell contains a dimple pattern. A first coating covers the inner shell. The first coating is applied as a liquid, wherein the first coating conforms to the dimple pattern on the inner shell. The first coating has a degree of elasticity greater than that of the plastic inner shell. A second coating covers the first coating. The second coating is also applied as a liquid, wherein the second coating conforms to the dimple pattern of the inner shell and the intervening first coating. The second coating has a degree of tear resistance greater than that of the plastic inner shell.

16 Claims, 2 Drawing Sheets

PRACTICE GOLF BALL DEVICE AND ITS ASSOCIATED METHOD OF MANUFACTURE

BACKGROUND OF THE INVENTION

1. Field of the Invention

In general, the present invention relates to practice golf balls. More particularly, the present invention relates to practice golf balls that are well below regulation weight and travel only a short distance when struck with a golf club.

2. Description of the Prior Art

As with many different sports, the key to being a good golf player is practice. The more a player practices, the more likely it is that a player will master the skills needed to play the game of golf well. The problem with practicing golf is that golf is a game that requires a lot of room to play. As such, when people practice golf, many cannot do so at their homes. Rather, many people are required to travel to golf courses, driving ranges or open fields in order to practice. Because practicing golf requires many people to travel away from their homes, golf practice is typically not performed with the frequency desired by the player.

In an attempt to make golf practice simpler, practice golf balls have been developed. Practice golf balls have a weight that is below that of a regulation golf ball. Consequently, when the practice golf ball is hit with a club, it is more vulnerable to wind resistance and travels a much shorter distance than does a regulation golf ball.

There exist many different types and styles of practice golf balls. The most common practice golf balls are hollow practice balls made of molded plastic. Such practice balls weigh only a fraction of a regulation golf ball and wind resistance prevents these practice balls from traveling more than twenty feet when struck with a golf club. Such practice golf balls are also very inexpensive and simple to manufacture. However, such practice golf balls have thin plastic walls that are easily ruptured or indented by a golf club. Consequently, such practice golf balls have a very short life.

Another disadvantage of hollow plastic practice golf balls is that they do not have enough mass to significantly effect the golf club when the face of the golf club strikes the ball. Consequently, a player cannot tell from the sound of the golf club strike whether or not the golf ball was solidly hit.

In an attempt to make better practice golf balls that last longer and act more like regulation golf balls, solid practice golf balls have been developed that have deadened cores. Such prior art practice golf ball designs are exemplified by U.S. Pat. No. 1,981,959 to Landreth, entitled Practice Golf Ball; U.S. Pat. No. 4,836,552 to Puckett, entitled Short Distance Golf Ball; and U.S. Pat. No. 5,782,702 to Yamagishi, entitled Practice Golf Ball. A problem with solid practice golf balls is that they tend to have a significant mass. As such, they travel much farther than hollow practice golf ball. Furthermore, since such practice golf balls are solid, they use much more material than do hollow golf balls. Consequently, they are far more expensive to manufacture than are hollow golf balls.

A need therefore exists in the art for a practice golf ball that is lightweight and is inexpensive, yet is tough and significantly interacts with the face of a golf club when struck. This need is met by the present invention as described and claimed below.

SUMMARY OF THE INVENTION

The present invention is a practice golf ball and its associated method of manufacture. The practice golf ball includes a hollow inner shell made of inexpensive molded plastic. The inner shell is molded so that the outer surface of the inner shell contains a dimple pattern. A first coating covers the inner shell. The first coating is applied as a liquid, wherein the first coating conforms to the dimple pattern on the inner shell. The first coating has a degree of elasticity greater than that of the plastic inner shell. A second coating covers the first coating. The second coating is also applied as a liquid, wherein the second coating conforms to the dimple pattern of the inner shell and the intervening first coating. The second coating has a degree of tear resistance greater than that of the plastic inner shell.

The result is a low cost practice golf ball that has a lightweight yet strong elastic and tear resistant properties.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
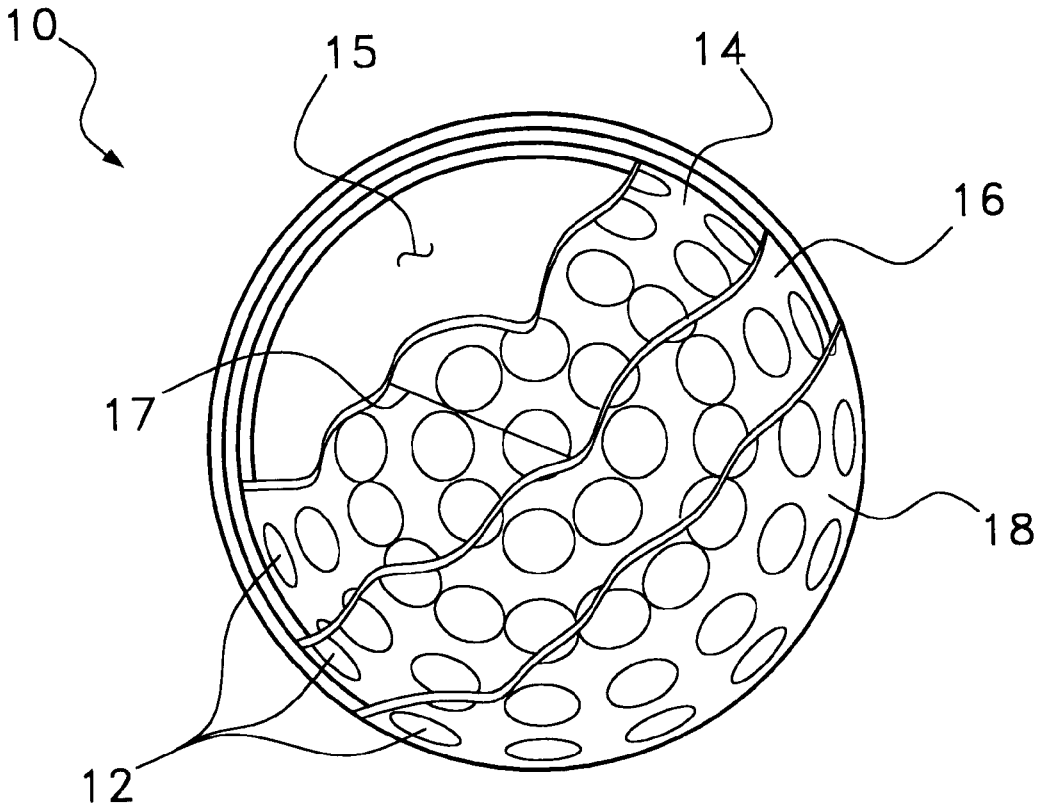
FIG. 1 is a partially fragmented front view of a practice golf ball in accordance with the present invention.

Referring to FIG. 1, a practice golf ball 10 is shown in accordance with the present invention. A regulation golf ball has a mass of just under 50 grams. The practice golf ball 10 of the present invention has a mass of between five and thirty grams which is a fraction of the mass of the regulation golf ball. The practice golf ball 10 has physical dimensions that are the same as a regulation golf ball or are only slightly larger than a regulation golf ball. The practice golf ball 10 also has a dimple pattern formed 12 on its exterior surface so that the practice golf ball 10 has the same general appearance as does a regulation golf ball.

Due to the size-to-weight ratio of the practice golf ball 10, the golf ball 10 is heavily effected by wind resistance when in flight. As such, the practice golf ball 10 has an approximate maximum range of between thirty meters and eighty meters when struck with any golf club. The range of the practice golf ball 10 can be altered by varying the weight of the practice golf ball 10 and/or eliminating the dimple pattern 12 on the exterior of the practice golf ball 10.

From FIG. 1, it can be seen that the practice golf ball 10 is made of an inner shell 14 and two coating layers. The inner shell 14 of the practice golf ball 10 is a thin walled plastic shell that is molded into a sphere. The dimple pattern 12 for the practice golf ball 10 is molded into the plastic of the inner shell 14. The plastic used in the molding of the inner shell 14 is preferably a low cost common polymer, such as polyvinyl chloride or its equivalent.

The inner shell 14 defines a hollow internal area 15 that is near or at ambient pressure. Since the inner shell 14 is molded, the inner shell 14 contains a seam line 17 where the two halves of the inner shell 14 are joined together. Due to its construction and composition, the inner shell 14 itself is not strong enough to resist multiple strikes from a golf club without rupturing or permanently indenting. The inner shell 14 is particularly vulnerable to rupture along the seam line.

To reinforce the inner shell 14, the inner shell 14 is coated in a first layer of material 16. The first layer of material 16 is applied as a liquid. As such, the first layer of material 16 maintains the dimple pattern 12 of the inner shell 14 when cured. The first layer of material 16 is preferably between 0.025 mm and 0.100 mm thick. The purpose of the first layer of material 16 is to provide a greater degree of resiliency and elasticity to the inner shell 14. As such, the inner shell 14 will be less likely to permanently indent when struck. The first layer of material 16 is preferably made of a curable polymer such as latex. However, other elastomeric polymers can be used. The elastomeric polymer can also be mixed with other non-elastomeric polymers suck as Kevlar to provide a greater degree of tear strength to the first layer of material 16.

A second layer of material 18 is coated over the first layer of material 16. The purpose of the second layer of material 18 is to provide the practice golf ball 10 with a highly tear resistant outer shell. It is the second layer of material 18 that is directly struck by the face of the golf club. As such, the second layer of material 18 must be able to withstand multiple impacts from a golf club without tearing. The second layer of material 18 is also applied as a liquid and is then cured. As such, the second layer of material 18 maintains the dimple pattern 12 of the inner shell 14 and the first layer of material 16 when cured. The second layer of material 18 is preferably between 0.025 mm and 0.200 mm thick.

The preferred choice for the second layer of material 18 is a thermoplastic polymer such as Surlyn, which is commonly used on the surface of regulation golf balls. The use of such a second layer of material 18 provides the needed tear resistance to the practice golf ball 10. Use of such a second layer of material 18 also provides the practice golf ball 10 with a degree of surface hardness that mimics that of a regulation golf ball. Consequently, when the practice golf ball 10 is struck by a golf club, the sound produced by the impact is similar to that when a regulation golf ball is used. A golfer can therefore audibly detect if the practice golf ball has been properly hit.

In an alternative embodiment, the second layer of material 18 can be a latex polymer that cures into solid with a high degree of hardness. With such a second layer of material 18, the second layer of material tends to chalk when struck with the face of a golf club. The second layer of material therefore leaves a mark on the face of the golf club. A golfer can then check the face of the golf club in order to determine if the practice golf ball was struck properly.

Figure 2:
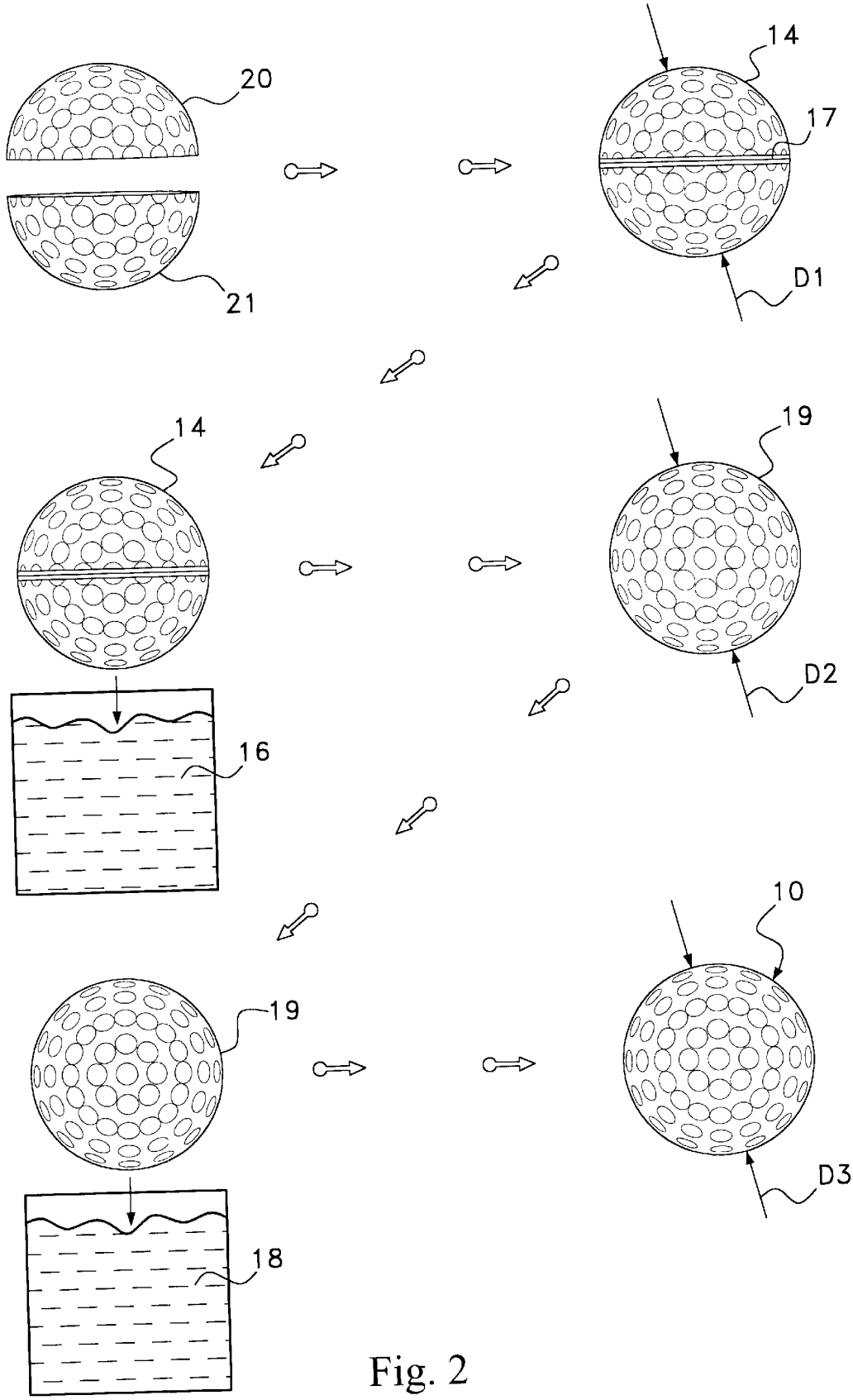
FIG. 2 is a schematic illustrating the manufacturing steps required to manufacture a practice golf ball in accordance with the present invention.

Referring now to FIG. 2, a method of manufacture for the present invention practice golf ball 10 can be described. To make the practice golf ball 10, two hemispherical halves 20, 21 of the inner shell 14 are molded using traditional plastic molding techniques. Each half of the inner shell 20, 21 is molded with a predetermined dimple pattern 12. The two halves 20, 21 of the inner shell are then joined along a common seam 17, thereby producing a complete spherical inner shell 14. The diameter Dl of the inner shell 14 can be the same as a regulation golf ball but is preferably slightly less than that of a regulation golf ball.

The inner shell 14 is then coated with a first layer of material 16. The coating process can be either a dipping procedure or a spraying procedure. The first layer of material 16 is liquid. As such, the first layer of material 16 conforms to the dimple pattern 12 on the inner shell 14. The first layer of material 16 increases the diameter of the partially complete practice ball 19 to a diameter D2.

The first layer of material 16 is cured. The partially complete practice ball 19 is then coated with a second layer of material 18. The coating process can be either a dipping procedure or a spraying procedure. The second layer of material 18 is also a liquid. As such, the second layer of material 18 conforms to the dimple pattern of the inner shell 14. The second layer of material 18 increases the diameter of the practice golf ball 10 to a diameter D3 that is at least equal to that of a regulation golf ball. Once the second layer of material 18 is cured, the practice golf ball 10 is complete.

The cost of the plastic inner shell 14 is very low. Furthermore, since the inner shell 14 is coated with secondary materials only a small mass of the secondary materials remains cured on each practice ball 10. As such, even if the secondary materials are expensive, the cost per piece of the practice golf balls remains extremely low.

The mass of the practice golf ball 10 can be varied by varying the thickness of the inner shell 12, the first layer of material 16 and/or the second layer of material 18. The aerodynamics of the practice golf ball 10 can be altered by altering or eliminating the dimple pattern 12 on the inner shell 14. By selectively altering these manufacturing variables, practice golf balls for different ranges can be produced. For example, by eliminating the dimple pattern and minimizing the weight of the practice golf ball, the range of the practice golf ball may have a twenty meter maximum. However, by providing an efficient dimple pattern and maximizing the weight of the practice golf ball, the range of the practice golf ball may have a eighty meter maximum.

It will be understood that the various FIGS. described above illustrate only one exemplary embodiment of the present invention. A person skilled in the art can make numerous alterations and modifications to the shown embodiment. All such modifications are intended to be included within the scope of the present invention as defined by the appended claims.

What is claimed is:

1. A practice golf ball, comprising:

a hollow inner shell made of molded plastic, said inner shell having an outer surface that contains a dimple pattern, wherein said molded plastic has a first degree of elasticity and tear resistance;

a first coating covering said inner shell, wherein said first coating conforms to said dimple pattern and has a degree of elasticity greater than said first degree of elasticity; and a second coating covering said first coating, wherein said second coating conforms to said dimple pattern and has a degree of tear resistance greater then said first degree of tear resistance.

2. The practice golf ball according to claim 1, wherein said first coating contains a cured elastomeric polymer.

3. The practice golf ball according to claim 2, wherein said elastomeric polymer includes latex.

4. The practice golf ball according to claim 1, wherein said second coating contains a cured thermoplastic polymer.

5. The practice golf ball according to claim 1, wherein said practice golf ball has a weight between five grams and thirty grams.

6. The practice golf ball according to claim 1, wherein said first coating is between 0.025 mm and 0.200 mm thick.

7. The practice golf ball according to claim 1, wherein said second coating is between 0.025 mm and 0.200 mm thick.

8. A method of manufacturing a practice golf ball, comprising the steps of:

proving a hollow spherical plastic shell;

coating said shell with a first material having a modulus of elasticity greater than that of said plastic shell;

curing said first material;

coating said first material with a second material having a resistance to tearing greater than that of said shell and said first material; and curing said second material.

9. The method according to claim 8, wherein said plastic shell has an exterior surface and a dimple pattern formed on said exterior surface.

10. The method according to claim 8, wherein said step of providing a hollow spherical plastic shell includes molding a first hemisphere and a second hemisphere and joining said first hemisphere to said second hemisphere along a common joint line.

11. The method according to claim 8, wherein said step of coating said shell with a first material, includes dipping said shell in said first material.

12. The method according to claim 8, wherein said step of coating said first material with a second material, includes dipping said shell in said second material.

13. A practice golf ball having a hollow center, said practice golf ball comprising:

a plastic shell defining the hollow center;

an elastomeric polymer covering said plastic shell, wherein said elastomeric polymer is between 0.025 mm and 0.100 mm thick; and a thermoplastic polymer covering said elastomeric polymer, wherein said thermoplastic polymer is between 0.025 mm and 0.200 mm thick.

14. The practice golf ball according to claim 13, wherein said plastic shell, said elastomeric polymer and said thermoplastic polymer share a common dimple pattern.

15. The practice golf ball according to claim 13, wherein said elastomeric polymer includes latex.

16. The practice golf ball according to claim 13, wherein said practice golf ball has a weight between five grams and thirty grams.

* * * * *